US005718774A

United States Patent [19]

Tukamoto et al.

[11] Patent Number: 5,718,774

[45] Date of Patent: Feb. 17, 1998

[54] METHOD OF PRODUCING BEVEL GEAR

[75] Inventors: Tetuo Tukamoto, Hadano; Kiyosi Okawachi, Odawara; Mitugu Kojima, Hadano; Shinji Fushimi, Yokosuka; Shunzo Umegaki, Yokohama; Takashi Matsumoto, Yokohama, all of Japan

[73] Assignees: Nissan Motor Co., Ltd., Yokohama; Nittan Valve Co., Ltd., Tokyo, both of Japan

[21] Appl. No.: 684,887

[22] Filed: Jul. 25, 1996

[30] Foreign Application Priority Data

Jul. 27, 1995 [JP] Japan ..... 7-192177

[51] Int. Cl.[6] ..... C23C 8/20; C23C 8/30; B21D 31/00

[52] U.S. Cl. ..... 148/219; 148/226; 72/364; 29/893.34; 29/893.36

[58] Field of Search ..... 29/893.3, 893.34, 29/893.36; 72/364; 148/219, 226

[56] References Cited

U.S. PATENT DOCUMENTS 3,398,444 8/1968 Nemy ..... 148/226

FOREIGN PATENT DOCUMENTS 59-153540 9/1984 Japan .
61-129249 6/1986 Japan .
62-27515 2/1987 Japan .
6-335827 12/1994 Japan .

*Primary Examiner*—P. W. Echols
*Attorney, Agent, or Firm*—Foley & Lardner

[57] ABSTRACT

A method of producing a bevel gear is provided. The method comprises the steps of forging, from a case hardened and heated blank, a rough shaped bevel gear intermediate product having a toothed portion, outer burrs at a larger diameter end thereof and between adjacent teeth of the toothed portion, and a ring-shaped inner burr in a center hole thereof, setting the rough shaped bevel gear intermediate product in a trimming die during the time the rough shaped bevel gear intermediate product remains in an elevated temperature condition due to heat left therein after the step of forging, and trimming the outer burrs, and moving, after the step of trimming, the rough shaped bevel gear intermediate product from the trimming die to a sizing die in the vicinity of the trimming die and warm sizing the toothed portion in succession to the step of trimming.

12 Claims, 3 Drawing Sheets

METHOD OF PRODUCING BEVEL GEAR

BACKGROUND OF THE INVENTION

1. Field of the Invention

The present invention relates to a method of producing a bevel gear, particularly by die forging.

2. Description of the Related Art

Latest examples of a method of producing a bevel gear by die forging will be described as follows.

(1) A first example is comprised of a step of hot die forging and a step of cold sizing, which is carried out after the step of hot sizing, for thereby assuring the accuracy of the tooth form.

In this instance, it is of a general practice to remove, after the forged intermediate product or work is cooled, outer burrs at a larger diameter end and between adjacent teeth by turning, while holding the forged work with a jig which is constructed so as to use a tooth surface as a reference surface, and remove an inner burr in a shaft mounting hole by drilling.

(2) A second example is comprised of a step of cold die forging.

A defect of hot forging is to attain a high accuracy. Cold die forging is used in the case a high accuracy is required, and generally a closed die forging is employed to this end. So, this method does not cause any burr and thus has such a feature that a process for removing burrs is unnecessitated.

(3) A third example is comprised of a step of hot forging gear teeth, i.e., a step of forging a work heated up to the temperature range of from 650° C. to 900° C., as disclosed in Japanese provisional Patent publication No. 59-153540.

A high working load is a defect of cold die forging. This method can lower the working load and thus can improve or elongate the life of the forging die.

(4) A fourth example is comprised of a step of hot forging teeth of a bevel gear from a work heated up to the temperature range of from 650° C. to 900° C., and a step of removing an inner burr in a shaft mounting hole by piercing and at the same time sizing the gear teeth during the time a forged work remains hot or warm (i.e., at the temperature range of from 600° C. to 850° C.) due to the heat for the hot forging, as disclosed in Japanese patent provisional publication No. 61-129249.

In the case bevel gears are mass-produced continuously by the above described third example, a wear is caused at the toothed portions of the die, resulting in a deteriorated accuracy of the gear. By this method, the forged work is warm sized and at the same time the inner burr in the shaft mounting hole is removed by piercing. So, this method makes it possible to produce a highly accurate bevel gear with efficiency. In the meantime, the outer burrs at the larger diameter end and between the adjacent teeth are removed by turning similarly to the above described first example.

(5) A fifth example is comprised of a step of forging a bevel gear from a carburized blank and a step of quenching the forged work, as disclosed in Japanese provisional publication No. 62-27515).

This method is suited for producing a bevel gear having a quite high strength.

In the case a bevel gear is produced by hot forging or warm forging as in the above described first, third and fourth examples, the inner burr formed in the shaft mounting hole is removed by drilling or piercing after the work is cooled. The outer burrs formed at the larger diameter end and between the adjacent teeth are removed by turning. Thereafter, a part-spherical rear face (i.e., a larger diameter end face) and the shaft mounting hole are machined so that the work is finished to a predetermined shape defined in the drawing. Finally, the work is carburized and hardened for use.

A problem of those methods is that the characteristics resulting from hot forging or warm forging, i.e., the effect of fine austenitic grains produced by forging and the effect of grain flow are weakened by heating at the time of carburizing, and thus it is difficult to make the fatigue life against impact longer and the fatigue strength in bending of tooth larger by 5% or more, respectively.

On the other hand, the cold forged bevel gear as by the second example is subjected to large plastic deformation and has portions which are different in the degree of working, so that when the austenite is recrystallized by heating at the time of carburizing, austenitic grains of different particle size are caused at the different portions of the gear by the influence of the different degrees of working, so the gear has a crystal structure of mixed grains. The gear of such mixed grains has a possibility of being low in impact strength or varying largely in impact strength. To overcome this defect, normalizing is needed, thus causing a problem of a high cost.

To solve the above problems, a new method of carburizing, forging and hardening has been proposed by the applicant of this application as in the fifth example and also disclosed in Japanese patent provisional publication No. 6-335827.

In the meantime, when it is tried to form, by hot forging only, a bevel gear having a tooth form accuracy which is higher than that of the third grade defined in Japanese Industrial Standards, a wear is caused at tooth crest portions of a die (i.e., portions corresponding to bottom land portions of a gear) in the middle of continuous mass-production, thus making it difficult to maintain a high accuracy. This fact is more pronounced in the case of closed hot forging of a heated blank. This is because the time of contact between the heated blank and the forging die becomes longer, so the hardness of the forging die is lowered due to annealing by the heat of the heated blank, and thus a wear of the forging die is easily caused. To prevent this, cold sizing is necessitated, thus causing a problem of a high manufacturing cost.

In the case of the method in which the forging and hardening steps are carried out after the step of carburizing, the forging step is carried out at a nearly hot temperature range of from 950° C. to 1100° C. Due to this, a wear was actually caused at the tooth crest portions of the forging die in the middle of continuous mass-production after the forging die was used to perform 4000 cycles of forging operations, and it was impossible to maintain the accuracy above the third grade defined in Japanese Industrial Standards thereafter.

Further, since the forged work manufactured by the method as in the above described fifth example, has a carburized layer at a surface section thereof, the hardness of the surface section thereof becomes as high as HRC 62~64 after the forged work is quenched. In this method, the forging step is performed so as to obtain the burrs of the thickness ranging from 0.3 to 0.5 mm, removal of the burrs can usually be attained by means of cold pressing. Further, electrical discharge machining can be utilized as another method for removing the burrs.

However, removal of burr by cold pressing is defective in the life of the die, and removal of burr by electrical discharge machining takes too much time, thus causing a problem of a high manufacturing cost.

SUMMARY OF THE INVENTION

According to an aspect of the present invention, there is provided a method of producing a bevel gear having a toothed portion between a smaller diameter end and a larger diameter end thereof, and a center hole. The method comprises the steps of forging, from a case hardened and heated blank, a rough shaped bevel gear intermediate product having the toothed portion, outer burrs at the larger diameter end and between adjacent teeth of the toothed portion, and a ring-shaped inner burr in the center hole, setting the rough shaped bevel gear intermediate product in a trimming die during the time the rough shaped bevel gear intermediate product remains in an elevated temperature condition due to heat left therein after the forging and trimming the outer burrs, and moving, after the trimming, the rough shaped bevel gear intermediate product from the trimming die to a sizing die in the vicinity of the trimming die and warm sizing the toothed portion in succession to the trimming. By this, the life of the forging die for obtaining a rough shaped bevel gear intermediate product can be long since the rough shaped bevel gear intermediate product is formed by hot or nearly hot forging. Further, the trimming die and the sizing die are used at a nearly hot or warm temperature for trimming the outer burrs and sizing the toothed portion of the intermediate product, so the working loads for the trimming and sizing can be considerably lowered and therefore the life of the die can be extended. Furthermore, even if a die wear is caused at the toothed portions of the forging die, the accuracy of the tooth form can be improved or made higher by warm sizing, thus making it possible to obtain a highly accurate bevel gear. Further, since the trimming of the outer burrs and the sizing are performed during the time the rough shaped bevel gear intermediate product remains in an elevated temperature condition due to heat left therein after the forging step, the method for forging the bevel gear can be small in loss of energy and can produce a bevel gear having a high accuracy and strength with efficiency and at low cost.

According to another aspect of the present invention, after the warm sizing, the rough shaped bevel gear intermediate product is quenched and tempered and thereafter the inner burr is trimmed off from the rough shaped bevel gear intermediate product, or the inner burr is trimmed off from the rough shaped bevel gear intermediate product first and thereafter the intermediate product is quenched and tempered. By the quenching and tempering after the sizing of the toothed portion and before removal of the inner burr, or by the quenching and tempering after the sizing and the removal of the inner burr, a bevel gear of an excellent toughness and a high quality can be obtained.

According to a further aspect of the present invention, the case hardened blank is obtained by carburizing. When the case hardening is attained by carburizing or carbonitriding, a bevel gear having an excellent fatigue strength and a high quality can be obtained.

According to a further aspect of the present invention, the case hardened blank is obtained by carbonitriding.

According to a further aspect of the present invention, the thickness of the ring-shaped inner burr in the center hole is limited to the range of from 0.3 mm to 1.3×t mm where t is the thickness (mm) of a hard surface layer of the inner burr. By limiting the thickness of the inner burr to the range of from 0.3 mm to 1.3×t mm where t is the thickness of the case hardened surface layer (mm), it becomes possible to prevent the edge of the punch from being subjected to a large resistance which may otherwise be caused by rapid cooling of the inner burr and at the same time it becomes possible to prevent the inner circumferential surface of the center hole from having a considerable portion which is not formed with a case hardened surface layer.

According to a further aspect of the present invention, the intermediate product in the elevated temperature condition is within a temperature range of from 850° C. to 1000° C. By setting the heat remaining condition to the temperature range of from 850° C. to 1000° C., the trimming die and the sizing die can have a long life and the accuracy of the bevel gear can be made high.

According to a further aspect of the present invention, the sizing die is placed just under the trimming die, the outer burrs of the rough shaped bevel gear intermediate product set in the trimming die are trimmed off by the trimming die as the rough shaped bevel gear intermediate product is driven downward by an upper punch, and the rough shaped bevel gear intermediate product is moved from the trimming die to the sizing die to be sized by the sizing die as it is driven further downward by the upper punch. By this, the trimming of the outer burr and the sizing can be performed in succession, so the working load can be lowered and the life of the die can be lengthened.

According to a further aspect of the present invention, there is provided a method of producing a bevel gear, which comprises the steps of preparing a hollow, cylindrical blank having a center hole and case hardening and heating the blank, forging, from the case hardened and heated blank, a rough shaped bevel gear intermediate product having a toothed portion, outer burrs at a larger diameter end thereof and between adjacent teeth of the toothed portion, and a ring-shaped inner burr in a center hole thereof, setting the rough shaped bevel gear intermediate product in a trimming die constituting part of a composite die assembly during the time the rough shaped bevel gear intermediate product remains in an elevated temperature condition due to heating for the forging and trimming the outer burrs, and setting, after the trimming, the rough shaped bevel gear intermediate product in a sizing die constituting part of the composite die assembly and located in the vicinity of the trimming die through movement thereof only in one axial direction and sizing the rough shaped bevel gear intermediate product in succession to the trimming.

According to a further aspect of the present invention, the trimming die of the composite die assembly is in the form of an ring-shaped plate and has a toothed, inner hole in which the tooth portion of the rough shaped bevel gear intermediate product fits.

According to a further aspect of the present invention, the sizing die is located just under and next to the trimming die and disposed concentric with same.

According to a further aspect of the present invention, the rough shaped bevel gear intermediate product has a part-spherical rear end surface and set in the trimming die in such a manner that the part-spherical rear end surface faces upward, the composite die assembly further including an upper punch having a lower end fittingly engaged with a larger diameter end face of the rough shaped bevel gear intermediate product, the rough shaped bevel gear intermediate product being moved from the trimming die to the sizing die by being driven by the upper punch.

The above described method of this invention is used for producing a bevel gear having a center hole. However, the blank is not necessarily hollow but can be solid. Further, in the case of a hollow blank being employed, the center hole can be formed by cutting such as drilling, or by plastic working. The hollow blank can otherwise be formed from metal tube or pipe.

There is no particular limitation of the metal for forming the bevel gear. The metal for forming the bevel gear can be such one that is selected arbitrarily from the group consisting of, for example, SC, SNC, SNCM, SCr, SCM, SMn, SMnC, etc. according to Japanese Industrial Standards and that is, for example, suited for case hardening, or selected arbitrarily from metals added with desired alloying elements.

The blank is case hardened prior to hot forging. In this connection, the case hardening is not limited to a particular method but can be attained by carburizing, carbonitriding, nitriding or any other suitable method. For example, in the case of carburizing being used, ordinary carburizing, high temperature carburizing, vacuum carburizing, etc. can be used according to the circumstances.

The case hardened, heated blank is die forged to form a rough shaped bevel gear intermediate product having a toothed portion between a larger diameter end and a smaller diameter end, outer burrs at the larger diameter end and between adjacent teeth of the toothed portion, and a ring-shaped inner burr in the center hole.

In carrying out the die forging step, a case hardened, heated blank having a center hole, a first forging die having a first punch which is inserted into the center hole through one of the opposite ends thereof, and a second forging die having a second punch which is inserted into the center hole through the other of the opposite ends thereof, are used to produce the rough shaped bevel gear intermediate product.

It is desirable, prior to the die forging step, to treat the surface of the heated blank by a surface lubricating process for forming on the surface of the blank a lubricant layer such as coating formed by chemical treatment using phosphoric acid, molybdenum disulfide coating, graphite coating, etc., as occasion calls.

By carrying out such a die forging, the toothed portion is formed between the larger diameter end and the smaller diameter end of the rough shaped bevel gear intermediate product, and the ring-shaped inner burr is formed between the first and second punches. In this instance, it is desirable to forge the inner burr in such a manner that the thickness of the ring-shaped inner burr (i.e., the distance between the first and second punches when the die is in the fully closed state or when the first and second punches assume their closest possible positions) is within the range of from 0.3 mm to 1.3×t mm (i.e., 130% of t) where t is the thickness (mm) of the inner burr.

in this connection, when the thickness of the ring-shaped inner burr (the distance between the punches opposing to each other) is smaller than 0.3 mm, the cooling speed of the inner burr becomes higher, thus subjecting the edges of the punches to a large resistance for thereby causing a larger deformation and wear of the punches and making shorter the die life. Thus, the thickness of the inner burr smaller than 0.3 mm is not desirable. On the other hand, when the thickness of the ring-shaped inner burr is larger than 1.3×t mm, the hard surface layer or case hardened layer is formed on the inner burr and therefore the inner circumferential surface of the center hole, after removal of the inner burr, has a considerable portion which is not case hardened and may possibly cause seizure in use with a shaft or may possibly cause an excessively large partial wear of the inner circumferential surface of the center hole. So, the thickness of the inner burr larger than 1.3×t is not desirable. For the above reason, it is desirable to set the thickness of the inner burr (i.e., the distance between the punches located in opposition to each other) within the range of from 0.3 mm to 130% of the thickness (t) of the hard-surface layer (i.e., 1.3×t mm).

Then, during the time the rough shaped bevel gear intermediate product obtained in the above manner remains in an elevated temperature condition due to heat left therein after the forging step, preferably, maintained at the temperature range of from 850° C. to 1000° C., it is set in the outer burr trimming die to trim off therefrom its outer burrs at the larger diameter end thereof and between the adjacent teeth, and then it is moved to the sizing die in the vicinity of the trimming die to size the toothed portion in succession to the trimming step.

In this instance, the sizing die is disposed just under the outer burr trimming die and concentrically with same, so that the outer burrs at the larger diameter end and between the adjacent teeth of the rough shaped bevel gear intermediate product can be trimmed off as the upper punch moves downward, and by further successive downward movement of the upper punch the rough shaped bevel gear intermediate product can be moved to the sizing die to size the toothed portion for thereby obtaining a finish forged bevel gear intermediate product.

Then, the finish forged bevel gear intermediate product is taken out from the sizing die, and the inner burr formed within the center hole is removed. Thereafter, the finish forged bevel gear intermediate product is held in a suitable atmosphere such as an atmosphere set to have a high carbon potential, an inert or non-oxidizing atmosphere and heated up to the quenching temperature, and then quenched and tempered.

After the quenching and tempering treatments, the black skin is removed from the heat treated intermediate product by shot blast or sand blast. Then, the intermediate product is subjected to finish machining for thereby obtaining a desired bevel gear. Otherwise, after the finish forged intermediate product is taken out of the sizing die, it is treated by quenching and tempering. Thereafter, the inner burr formed within the center hole is removed and the intermediate product is finish machined to obtain a desired bevel gear.

The above structure is effective for solving the above noted problem inherent in the prior art method.

It is accordingly an object of the present invention to provide a method of producing a bevel gear which makes it possible to lengthen a forging die used in carrying out the method and can produce a highly accurate bevel gear with efficiency and at low cost.

DETAILED DESCRIPTION OF THE PREFERRED EMBODIMENT

Figure 1:
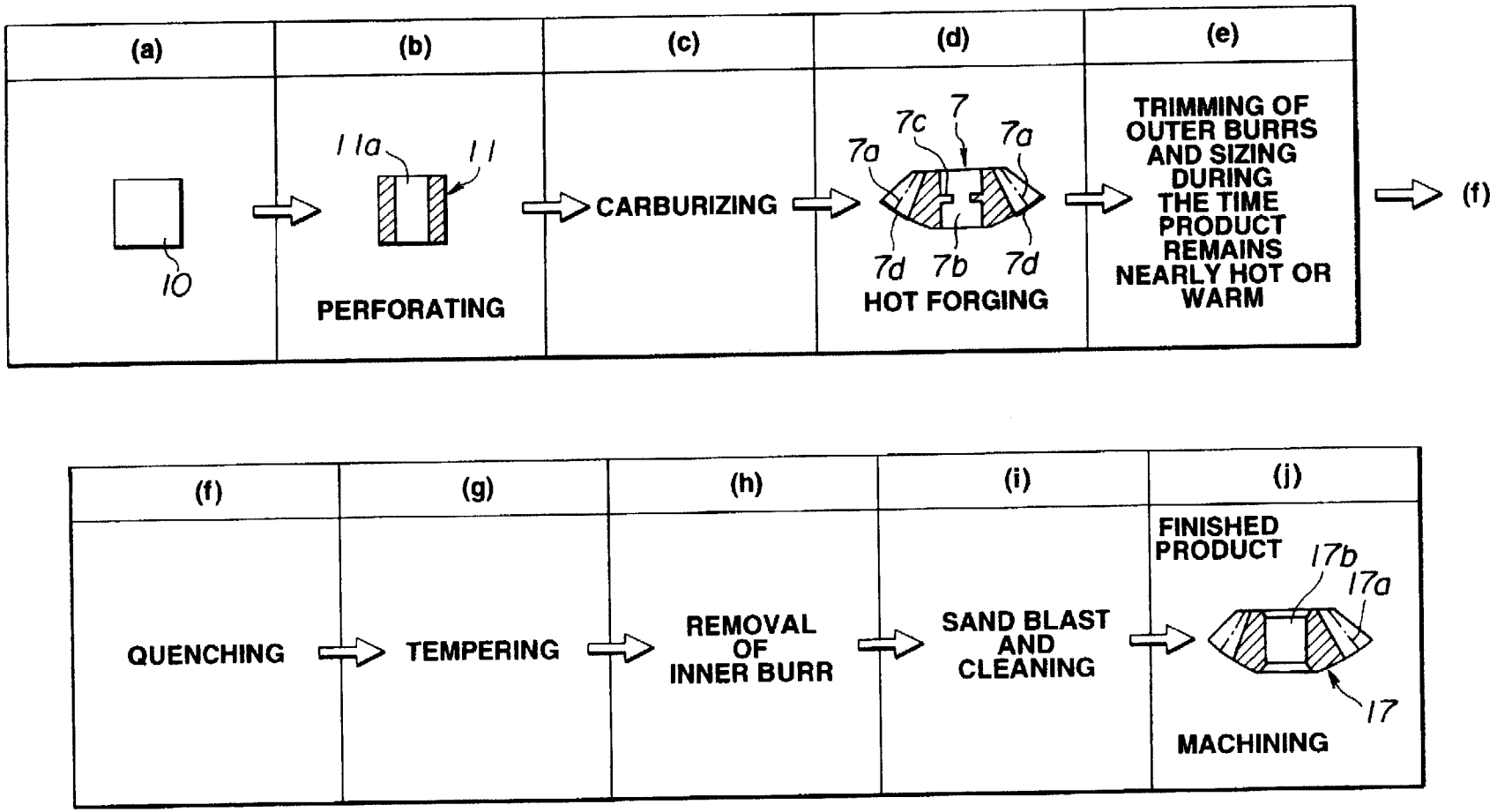
FIG. 1 is a flow chart for illustrating the processes or steps of a bevel gear producing method according to an embodiment of the present invention.
Figure 2:
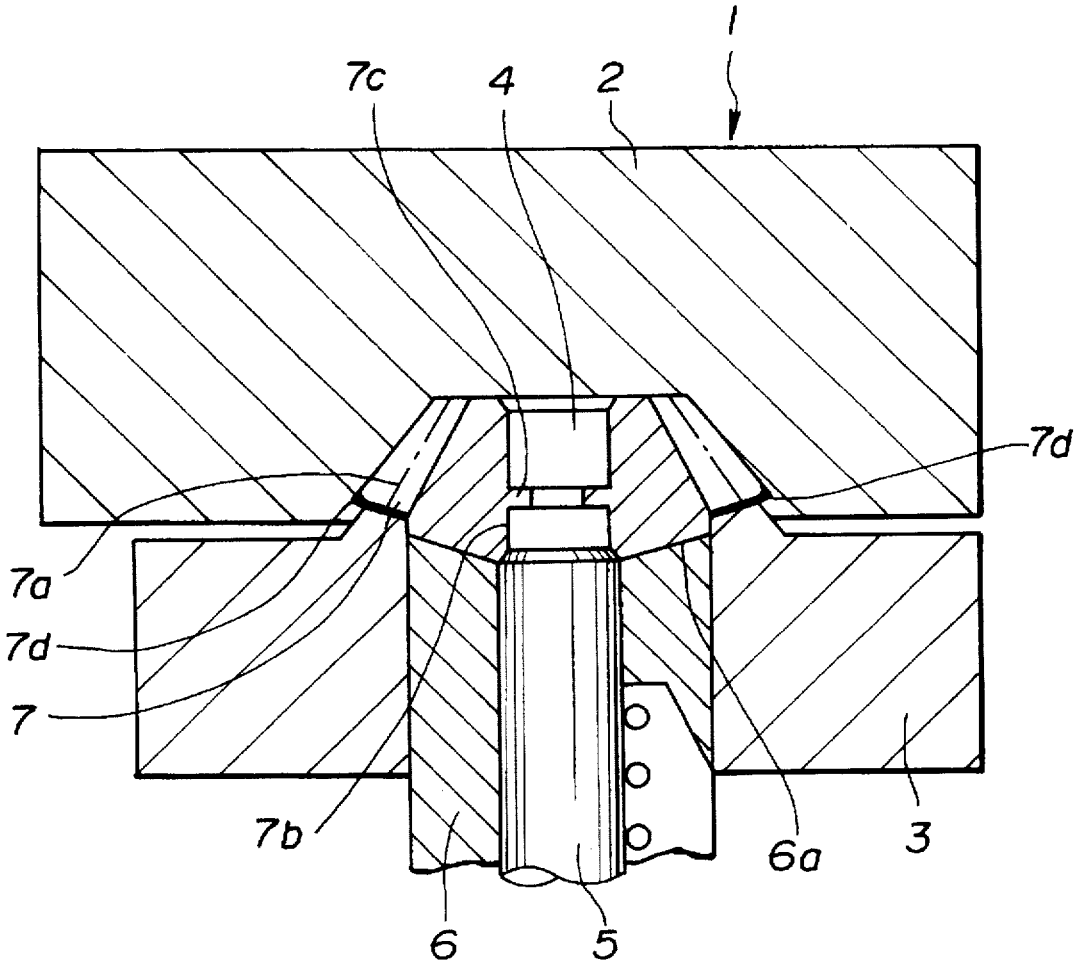
FIG. 2 is a longitudinal sectional view of a principal portion of a forging die used for carrying out the hot forging step (d) of the bevel gear producing method of FIG. 1.

Referring first to FIGS. 1 and 2, a bevel gear producing method according to an embodiment of the present invention will be described.

To produce a carburized and forged bevel gear, a blank is first prepared. To this end, a solid round bar 10 of SCM418H and 28 mm in diameter is cut to a required length as shown in the step (a) in FIG. 1. SCM418 is crome molybdenum steel defined in Japanese Industrial Standards and has the composition of 0.17% C, 0.30% Si, 0.63% Mn, 0.09% Ni, 1.02% Cr, 0.16% Mo, 0.019% Al, 0.0012% O, 0.0155% N and the remainder of Fe and impurity. The solid round bar 10 cut to a desired length is then formed with a center hole 11*a* by machining or cold forging as illustrated in the step (b) of FIG. 1. In this manner, a hollow gear blank 11 of 28 mm in outer diameter, 16 mm in inner diameter and 31 mm long is obtained.

Then, as shown in the step (c) of FIG. 1, the above described hollow gear blank 11 is subjected to gas-carburizing at the temperature of 920° C. for five hours, and thereby a hollow gear blank having been carburized in such a manner as to have an effective case depth (i.e., thickness of hardened surface layer) of 0.09 mm is obtained.

The gear blank is then subjected to high frequency heating whilst being subjected to flow of nitrogen gas, so as to be heated up to the forging temperature, i.e., 1000±10° C., whereby a heated blank having been processed by carburizing is obtained. Thereafter, in the step (d) of FIG. 1, by using the carburized and heated blank and a forging die 1 shown in FIG. 2, a forging step for forging gear teeth is carried out.

The forging die 1 shown in FIG. 2, includes an upper die block 2, a first lower die ring 3, and an upper punch 4 fixedly attached to the upper die block 2 to constitute therewith an integral unit. The upper punch 4 is thus of a fixed or stationary type.

The forging die 1 further includes a lower punch 5 and a second lower die ring 6 installed in the first lower die ring 3 and placed around the lower punch 5 in such a manner as to have a part-spherical seat 6*a* at the upper end thereof. The second lower die ring 6 is thus of a movable type, i.e., movable axially of the lower punch 5 or vertically in FIG. 2.

In FIG. 2, the forging die 1 is shown in a closed state to form the heated and carburized blank 11 into a rough shaped bevel gear intermediate product 7. The intermediate product 7 has a toothed portion 7*a*, a central hole 7*b* having a ring-shaped inner burr 7*c* between the upper and lower punches 4 and 5, and outer burrs 7*d* at the outer diameter end and between adjacent teeth of the toothed portion 7*a*. This corresponds to the step (d) of FIG. 1.

In the forging die 1 used in this embodiment, the upper die block 2, first lower die ring 3, upper punch 4, lower punch 5 and second lower die ring 6 are made of SKD 62 according to Japanese Industrial Standards and hardened and tempered after machining so as to have the hardness of Rockwell C 60. In the production of the upper die block 2, first lower die ring 3 and second lower die member 6, electrical discharge machining based on a copper tooth master model is used.

By using such a forging die 1, the hollow, cylindrical gear blank 11 is forged to have gear teeth as follows. Firstly, the gear blank 11 is positioned in place on the part-spherical seat 6*a* of the second lower die ring 6. The upper die block 2 and the upper punch 4 are moved downward in such a manner as to make the upper punch 4 and the lower punch 5 be driven into the center hole 11*a* of the gear blank 11 through the opposite ends thereof, i.e., the upper and lower ends thereof. The position of the lower punch 5 relative to the first lower die ring 3 and the second lower die ring 6 when the forging die 1 is fully closed, is previously set so as to provide a clearance within the range of from 0.6 to 0.7 mm when the forging die 1 is fully closed, i.e., the upper die block 2 and the upper punch 4 assume their lowest possible positions. By this, the rough shaped bevel gear intermediate product 7 having the ring-shaped inner burr 7C of the thickness within the range of from 0.6 to 0.8 mm between the upper and lower punches 4 and 5 and outer burrs 7*d* at the larger diameter end and between the adjacent teeth of the toothed portion 7*a*, is obtained. The rough shaped bevel gear intermediate product 7 is formed in such a manner that the amount of finish by the later finish machining, i.e., finish machining of the rear face and finish machining of the inner surface of the center hole 7*b*, is within the range of from 0.3 to 0.5 mm.

Figure 3:
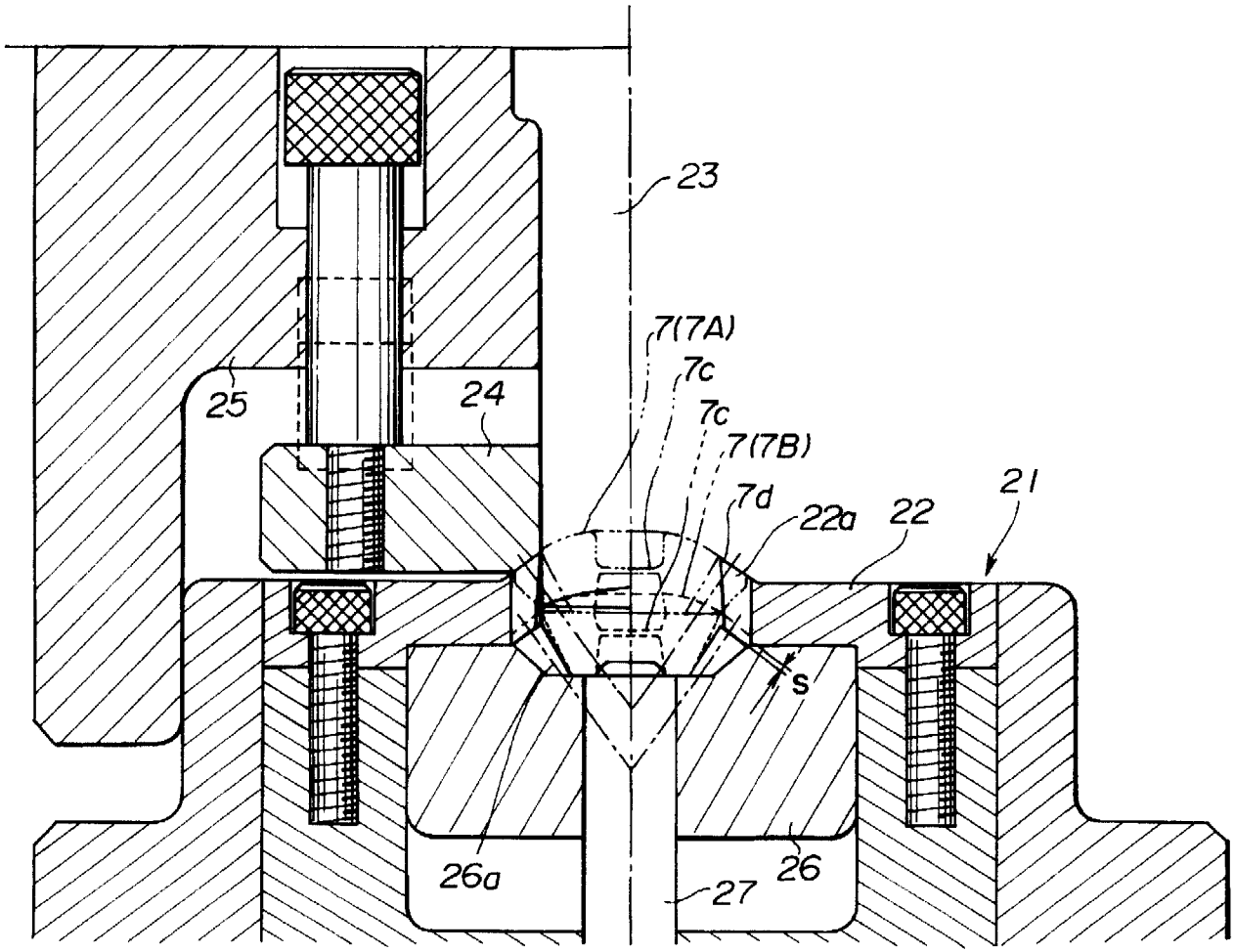
FIG. 3 is a longitudinal sectional view of a principal portion of a composite die assembly composed of a die for removal of outer burr and a sizing die, used for carrying out the trimming and sizing step (e) of the bevel gear producing method of FIG. 1.

Then, the rough shaped bevel gear intermediate product 7 having the toothed portion 7*a* is taken out from the forging die 1 and then moved to a composite die assembly 21 shown in FIG. 3 during the time the rough shaped intermediate product 7 remains nearly hot or warm due to the heat for the forging, e.g., in a state of remaining heated at the temperature range of from about 850° C. to 1000° C. This corresponds to the step (e) of FIG. 1.

The composite die assembly 21 shown in FIG. 3 includes an outer burr trimming die 22 and a sizing die 26. The sizing die 26 is positioned just under the trimming die 22. The composite die assembly 21 further includes an upper punch 23 for pushing the rough shaped bevel gear intermediate product 7 in an upset state downward, a presser ring 24 for pressing the outer burr 7*d* and a die holder 25 for holding the punch 23 and the presser ring 24, a knockout pin 27, etc.

In operation, the rough shaped bevel gear intermediate product 7 just after the forging step (d) is held in an upset state and set in the composite die assembly 21, i.e., in the trimming die 22. As the die holder 25 goes downward together with the punch 23, the presser ring 24 comes to contact the outer burrs 7*d* to press down the same. Then, the rough shaped bevel gear intermediate product 7 goes downward as the punch 23 in contact with the part-spherical rear face of the intermediate product 7 goes downward. In this instance, the outer burrs 7*d* are removed when moved downward to the position where a blade portion 22*a* of the trimming die 22 is located, i.e., when the rough shaped bevel gear intermediate product 7 goes downward to the position 7(7A) indicated by two-dot chain lines in FIG. 3. The rough shaped bevel gear intermediate product 7 goes further downward by being pushed by the punch 23 and set in the sizing die 26 just under the trimming die 22. The rough shaped bevel gear intermediate product 7 is sized by the sizing die 26 when it goes downward to the position 7(7B) indicated by the dotted lines in FIG. 3. In this connection, the indentation of the upper punch 23 (i.e., the amount by which the upper punch 23 is pressed in the rough shaped bevel gear intermediate product 7) is desired to be 0.1 mm or less since the accuracy in the tooth form may possibly be deteriorated or lowered when the indentation is larger.

By carrying out the removal of the outer burrs 7C and the warm sizing in succession after the hot forging step (e), the life of the forging die 1 can be extended two to four times longer. Further, the life of the sizing die 26 can be equal to or longer than that of a comparable prior art cold sizing die, and the accuracy of the tooth form or profile can be maintained higher than the third grade defined in Japanese Industrial Standards during the life of the sizing die 26.

The bevel gear having completed the sizing step (e) is removed from the sizing die 26 and the outer burr trimming die 22 by the operation of the knockout pin 27. The thus sized and trimmed bevel gear intermediate product is made to pass in about thirty seconds a tunnel type heating furnace (not shown) the inside temperature of which is adjusted to the range of from 820° C. to 840° C. and through which inert gas flows, and heated up to the quenching temperature, in order to make uniform the quenching temperature and accelerate recrystallization whilst preventing decarubrizing, and thereafter put in the oil of the temperature within the range of from 80° C. to 100° C. and quenched. This corresponds to the step (f) of FIG. 1. Thereafter, the thus quenched bevel gear intermediate product is subjected to tempering at the temperature of 170° C. for two hours. This corresponds to the step (g) of FIG. 1. After the quenching step (f) and tempering step (g), the inner burr *7c* in the center hole *7b* of the intermediate product 7 is removed by cold pressing. This corresponds to the step (h) of FIG. 1. Then, the bevel gear intermediate product 7 is subjected to cleaning by sand blast. This corresponds to the step (i) of FIG. 1. By this, the black surface skin is removed. In the meantime, the quenching and tempering can be made after removal of the inner burr *7c* in the center hole *7b*.

The bevel gear intermediate product carburized, forged and hardened in the above manner is attached to a jig constructed to use a tooth surface as a reference surface, and only the inner surface of the center hole and the part-spherical rear face are finished by hard turning (turning of hard material) by means of a tool of c-BN (cubic system boron nitride), whereby a bevel gear 17 having a highly accurate toothed portion *17a* and a center hole *17b* of a high concentricity is obtained. This corresponds to the step (j) of FIG. 1.

What is claimed is:

1. A method of producing a bevel gear having a toothed portion between a smaller diameter end and a larger diameter end thereof, and a center hole, the method comprising the steps of:

forging, from a case hardened and heated blank, a rough shaped bevel gear intermediate product having said toothed portion, outer burrs at said larger diameter end and between adjacent teeth of said toothed portion, and a ring-shaped inner burr in said center hole;

setting said rough shaped bevel gear intermediate product in a trimming die during the time said rough shaped bevel gear intermediate product remains in an elevated temperature condition due to heat left therein after said forging, and trimming said outer burrs; and moving, after said trimming, said rough shaped bevel gear intermediate product from said trimming die to a sizing die in the vicinity of said trimming die and warm sizing said toothed portion in succession to said trimming.

2. A method according to claim 1, wherein after said warm sizing, said rough shaped bevel gear intermediate product is quenched and tempered, and thereafter said inner burr is trimmed off from said rough shaped bevel gear intermediate product.

3. A method according to claim 1, wherein after said warm sizing, said inner burr is trimmed off from said rough shaped bevel gear intermediate product and thereafter said intermediate product is quenched and tempered.

4. A method according to claim 1, wherein said case hardened blank is obtained by carburizing.

5. A method according to claim 1, wherein said case hardened blank is obtained by carbonitriding.

6. A method according to claim 1, wherein the thickness of said ring-shaped inner burr in said center hole is limited to the range of from 0.3 mm to 1.3×t mm where t is the thickness (mm) of a hard surface layer of said inner burr.

7. A method according to claim 1, wherein said intermediate product in said elevated temperature condition is within a temperature range of from 850° C. to 1000° C.

8. A method according to claim 1, wherein said sizing die is placed just under said trimming die, said outer burrs of said rough shaped bevel gear intermediate product set in said trimming die are trimmed off by said trimming die as said rough shaped bevel gear intermediate product is driven downward by an upper punch, and said rough shaped bevel gear intermediate product is moved from said trimming die to said sizing die to be sized by said sizing die as it is further driven downward by said upper punch.

9. A method of producing a bevel gear comprising the steps of:

preparing a hollow, cylindrical blank having a center hole, and case hardening and heating said blank;

forging, from said case hardened and heated blank, a rough shaped bevel gear intermediate product having a toothed portion, outer burrs at a larger diameter end thereof and between adjacent teeth of said toothed portion, and a ring-shaped inner burr in a center hole thereof;

setting said rough shaped bevel gear intermediate product in a trimming die constituting part of a composite die assembly during the time said rough shaped bevel gear intermediate product remains in an elevated temperature condition due to heating for said forging, and trimming said outer burrs; and setting, after said trimming, said rough shaped bevel gear intermediate product in a sizing die constituting part of said composite die assembly and located in the vicinity of said trimming die through movement thereof only in one axial direction and sizing said rough shaped bevel gear intermediate product in succession to said trimming.

10. A method according to claim 9, wherein said trimming die of said composite die assembly is in the form of an ring-shaped plate and has a toothed, inner hole in which said tooth portion of said rough shaped bevel gear intermediate product fits.

11. A method according to claim 10, wherein said sizing die is located just under and next to said trimming die and disposed concentric with same.

12. A method according to claim 11, wherein said rough shaped bevel gear intermediate product is set in said trimming die in such a manner that said larger diameter end faces upward, said composite die assembly further including an upper punch having a lower end fittingly engaged with said larger diameter end of said rough shaped bevel gear intermediate product, said rough shaped bevel gear intermediate product being moved from said trimming die to said sizing die by being driven by said upper punch.

* * * * *